US005808584A

United States Patent [19]

Skahill

[11] Patent Number: 5,808,584

[45] **Date of Patent: *Sep. 15, 1998**

[54] DIPOLE TELEVISION ANTENNA

[75] Inventor: George Skahill, Greenlawn, N.Y.

[73] Assignee: NTL Technologies Corporation, Greenlawn, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 655,766

[22] Filed: May 30, 1996

[51] Int. Cl.[6] ..... H01Q 9/26

[52] U.S. Cl. ..... 343/803

[58] Field of Search ..... 343/803, 802, 343/821, 804, 806; H01Q 9/06, 9/26

[56] References Cited

U.S. PATENT DOCUMENTS 2,850,734 9/1958 Person ..... 343/803

3,868,689 2/1975 Liu et al. ..... 343/821

FOREIGN PATENT DOCUMENTS 692692 6/1953 United Kingdom ..... 343/803

*Primary Examiner*—Michael C. Wimer

*Attorney, Agent, or Firm*—Hoffmann & Baron, LLP

[57] ABSTRACT

A dipole antenna with folded back ends. Linear conductor elements are fed by a balanced two-wire transmission line which is connected to a balun transformer in turn connectable to a coaxial line. Preferably, the balun transformer is a small device, made of a ferrite donut wound with thin wire and occupying less than one cubic inch. The transformer is preferably located at the feed point and can then be incorporated into the antenna.

6 Claims, 2 Drawing Sheets

DIPOLE TELEVISION ANTENNA

BACKGROUND OF THE INVENTION

This invention relates to a television antenna. More particularly, this invention relates to a television antenna of the dipole type.

An efficient television antenna must be designed while keeping in mind many considerations in practical electromagnetics. Dipole antennas for receiving commercial television broadcasts must satisfy or balance among many inharmonious engineering requirements. For example, an all-channel antenna must be capable of adequately receiving signals across a broad spectrum of frequency ranges which extend from a band of 54 MHZ to 72 MHZ, in 6 MHZ increments (Channels 2, 3, and 4), to a UHF band of 470 MHZ to 890 MHZ, in 6 MHZ increments (Channels 14 through 83). For each of the lowest numbered channels, because the channel bandwidth exceeds 10 percent and wavelength exceeds 16 feet, dipole antennas sized for set-top installation exhibit such highly capacitative and high Q impedance properties that individual channel matching circuits are needed to increase the amount of broadcast signal delivered to the receiver. For the highest numbered channels, because bandwidth is less than one percent and wavelength is less than 14 inches, antennas sized for set-top installation can exhibit inherently satisfactory impedance properties over a frequency range encompassing many channels, often the entire UHF broadcast band.

A basic problem in attempting a set-top design that receives all VHF and UHF broadcast channels efficiently is that an antenna with an electrical extent large enough to facilitate impedance matching at each of the lowest frequency channels, particularly Channels 2 and 3, has such a large electrical extent at the highest frequency channels that the radiation patterns can exhibit sizeable frequency variations, leading to amplitude and/or phase weightings of a received broadcast signal over its frequency band and substantially diminished quality of reception. Additionally, the small electrical extent of a set-top dipole antenna at each of the lower frequency channels ensures a low value of radiation resistance while, at the higher VHF channels, its electrical extent can approach a wavelength, ensuring a high value of radiation resistance. In summary, the antenna's electrical extent is too little at low VHF because of low resistance levels, too large at high VHF because of the high resistance levels, and much too large at UHF because of pattern dispersions. The superposition of an antenna configuration that can perform well at Channel 2 with one that can perform well at Channels 3, 4, etc., and can be easily reconfigured for efficient operation at any channel is a demanding requirement because of the inharmonious factors and the resulting inharmonious engineering requirements.

In dipole antenna assemblies, the antenna is connected to a transformer via a balanced two-wire transmission line. The transformer is in turn connected to the television antenna input port via an unbalanced coaxial transmission line. The devices for transforming from balanced to unbalanced transmission lines (baluns) must be very large to operate efficiently at the lower frequencies or must employ ferrite devices that result in attenuation at the higher frequencies. Similarly, some of the circuit components used in "broadband" matching over the extent of each channel at lower frequencies can be sizable or can use ferrite devices with attenuation at lower frequencies.

Improving the reception range of indoor television antennas is limited by the available height above ground and the achievable antenna gain, particularly at the low frequency channels. Actually, given the size limitations that must be imposed on set-top antennas, the only feasible improvements are in the efficiency of the antenna in extracting the maximum broadcast signal from the air and in delivering that signal to the television receiver.

It has been discovered that most fully extended rabbit-ear type antennas are at least 10 dB deficient at Channel 2 compared with a reference high quality dipole configured for a frequency of 57 MHZ. It is likely that a major cause of this low efficiency is radio-frequency attenuations between interconnected sections of the telescoping tubes of the antenna. It is also possible that these losses increase with time and use.

It appears that the conventional rabbit-ear antenna is in need of replacement with an updated or improved design.

OBJECTS OF THE INVENTION

An object of the present invention is to provide an improved television antenna.

Another object of the present invention is to provide a television antenna, different from the conventional rabbit-ear design, which has satisfactory reception characteristics even without adjustment.

An additional object of the present invention is to provide a television antenna with an improved reception range and/or improved efficiency.

These and other objects of the present invention will be apparent from the drawings and detailed descriptions provided below.

SUMMARY

Basically, a dipole antenna in accordance with the present invention is a straight dipole with folded back ends. Linear conductor elements are fed by a balanced two-wire transmission line which is connected to a balun transformer in turn connectable to a coaxial line. Preferably, the balun transformer is a small device, made of a ferrite donut wound with thin wire and occupying less than one cubic inch. The transformer is preferably located at the feed point and can then be incorporated into the antenna.

Such a television antenna device comprises, in accordance with one conceptualization of the present invention, a first conductor, a second conductor, and a third conductor. The first conductor has a central segment and a pair of opposite end segments folded back to overlap the central segment, the end segments extending substantially parallel to the central segment and spaced therefrom. The second conductor and the third conductor are each approximately half as long as the first conductor. The second conductor has a first major portion and a first end portion folded back at a first fold to overlap the first major portion, while the third conductor has a second major portion and a second end portion folded back at a second fold to overlap the second major portion. The end portion of the second conductor extends substantially parallel to the second conductor's major portion in spaced relation thereto, the end portion being connected at an end opposite the first fold to one of the end segments of the first conductor. The end portion of the third conductor extends substantially parallel to the major portion of the third conductor in spaced relation to that major portion. The end portion of the third conductor is connected at an end opposite the second fold to another of the end segments of the first conductor.

More specifically, the central segment of the first conductor is spaced a pre-established distance from the major portions of the second conductor and the third conductor. In addition, the end segments of the first conductor are spaced a predetermined distance from the central segment, while the end portions of the second and third conductors are preferably spaced by essentially the same predetermined distance from the respective major portions of the second and the third conductors. The predetermined distance, between the end segments and the central segment of the first conductor and between the end portions and the major portions of the second and the third conductors, is preferably approximately 0.75 inch, while the pre-established distance, between the central segment of the first conductor and the major portions of the second and the third conductors, is preferably approximately 1.5 inches. Also, the central segment of the first conductor preferably has a length of approximately 73 inches and the end portions of the second and the third conductors each have a length of approximately 5.5 inches.

According to another feature of the present invention, a balun transformer is connected to the second conductor at an end thereof opposite the first end portion and to the third conductor at an end opposite the second end portion. The balun transformer preferably comprises a ferrite torus and windings of thin wire and occupies a volume of substantially less than one cubic inch.

A television antenna in accordance with the present invention is different from the conventional rabbit-ear design and exhibits satisfactory reception characteristics even without adjustment. The antenna has an improved reception range and improved efficiency.

An antenna in accordance with the present invention is simple and easy and inexpensive to manufacture. Reception is satisfactory over a wide range of frequency bands.

DESCRIPTION OF THE PREFERRED EMBODIMENT

Figure 1:
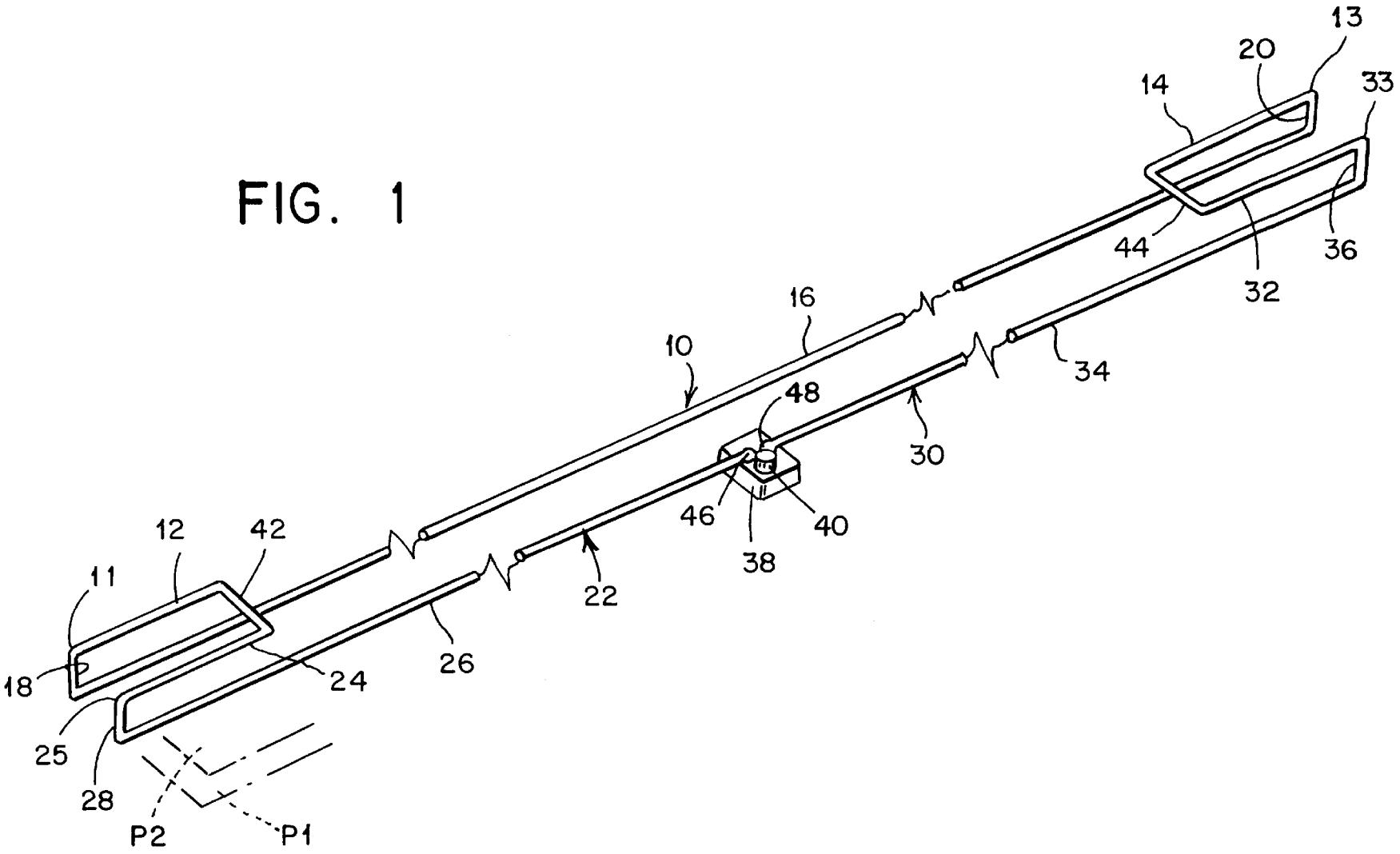
FIG. 1 is a schematic perspective view, on a reduced scale, of a folded dipole antenna in accordance with the present invention.

A dipole television antenna device comprises a first linear conductor 10 having a total length of approximately 85.5 inches. Conductor 10 has linear end segments 12 and 14 folded back at bends 11 and 13 over a linear central segment 16. Each end segment 12 and 14 is approximately 5.5 inches long and extends parallel to central segment 16. End segments 12 and 14 are connected to central segment 16 by respective connector segments 18 and 20 each approximately 0.75 inch long. Central segment 16 is approximately seventy-three inches in length.

The antenna further comprises a second linear conductor 22. Conductor 22 has a 5.5-inch linear end portion 24 of a 0.05-inch diameter folded back at a bend 25 over a 36.5-inch linear major portion 26 of 0.125-inch diameter. End portion 24 extends parallel to major portion 26 and is spaced approximately 0.75 inch therefrom by a linear connector piece 28 having a diameter of 0.05 inch.

A third linear conductor 30 is a mirror image of conductor 22. Accordingly, conductor 30 is provided with a 5.5-inch linear end portion 32 of a 0.05-inch diameter folded back at a bend 33 over a 36.5-inch linear major portion 34 of a 0.125-inch diameter. End portion 32 is parallel to major portion 34 and is spaced approximately 0.75 inch therefrom by a linear connector piece 36 having a diameter of about 0.05 inch.

The difference in the diameters of end portions 24 and 32, on the one hand, and major portion 26 and 34, on the other hand, serves to adjust impedance level. The limitation of the thicker diameter of 0.125 inch to major portions 26 and 34 facilitates manufacture of the dipole antenna.

Conductors 22 and 30 are colinear and extend substantially parallel to conductor 10. At their juxtaposed inner ends, conductors 22 and 30 are connectable to respective members of a balanced two-wire feed line (not shown). Preferably, however, conductors 22 and 30 are connected at their inner ends or terminals 46 and 48 to a small balun transformer 38 having a coaxial connector 40 for receiving a coaxial line (not shown) extending to a television receiver (not shown). Transformer 38 is a 75Ω to 300Ω transformer preferably comprising a ferrite torus and windings of thin wire and occupies a volume of substantially less than one cubic inch. Transformer 38 is preferably located at the feed point of the antenna and is incorporated into the antenna. Conductors 10, 22 and 30 may be provided with dielectric sheathing (not shown) for assisting in the support of the two dipole arms, which extend on opposite sides of the feed point and transformer 38. The dielectric materials must exhibit low loss, radio frequency properties at commercial television frequencies. Radio frequency conductivity across any metal-to-metal junctions must be excellent.

End segments 12 and 14 of conductor 10 are connected to respective end portions 24 and 32 of conductors 22 and 30 via generally linear connecting conductors 42 and 44 each approximately 1.5 inches long.

The total length of the described preferred embodiment of an antenna formed in accordance with the present invention is approximately 174 inches long. This is approximately equal to one wavelength (λ) in the frequency region of 54–66 MHZ, which covers television broadcast channels 2, 3 and 4. Conductor segments 12-42-24 and 14-44-32, which form folded end sections of the antenna, each have a combined length of approximately 12.5 inches. This length is approximately equal to ¼ of a wavelength (λ/4) at 210 MHZ, which corresponds to television broadcast channel 13.

Conductors 10, 22 and 30 lie in a first plane P1 while end segments 12 and 14 and end portions 24 and 32 define a second plane P2 oriented parallel to plane P1. Connector segment 18 and linear connector piece 28 define a first fold plane F1, while connector segment 20 and linear connector piece 36 define another fold plane F2 parallel to the first. These fold planes F1 and F2 are substantially perpendicular to planes P1 and P2.

Figure 2:
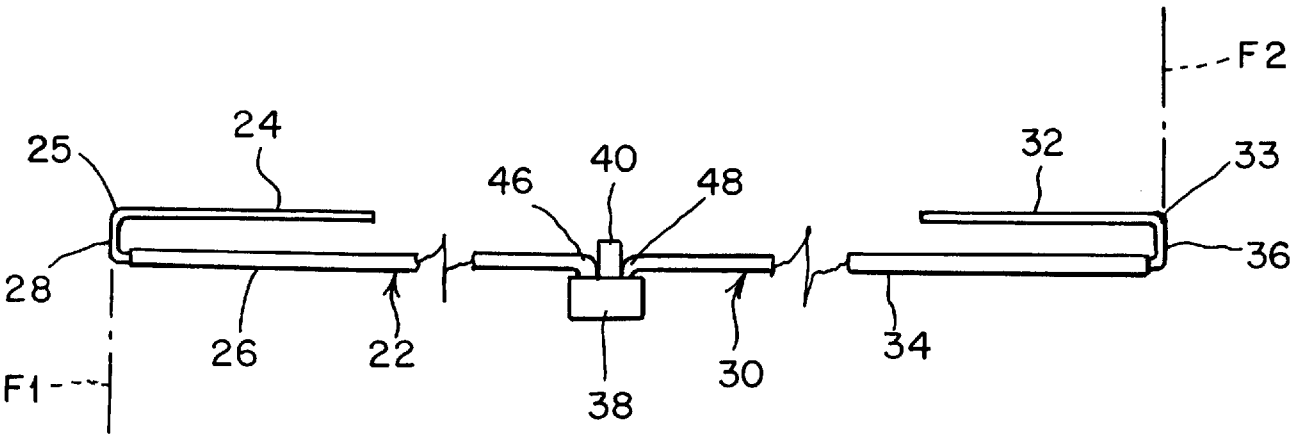
FIG. 2 is a schematic side elevational view, on a similarly reduced scale, of the folded dipole antenna of FIG. 1.
Figure 3:
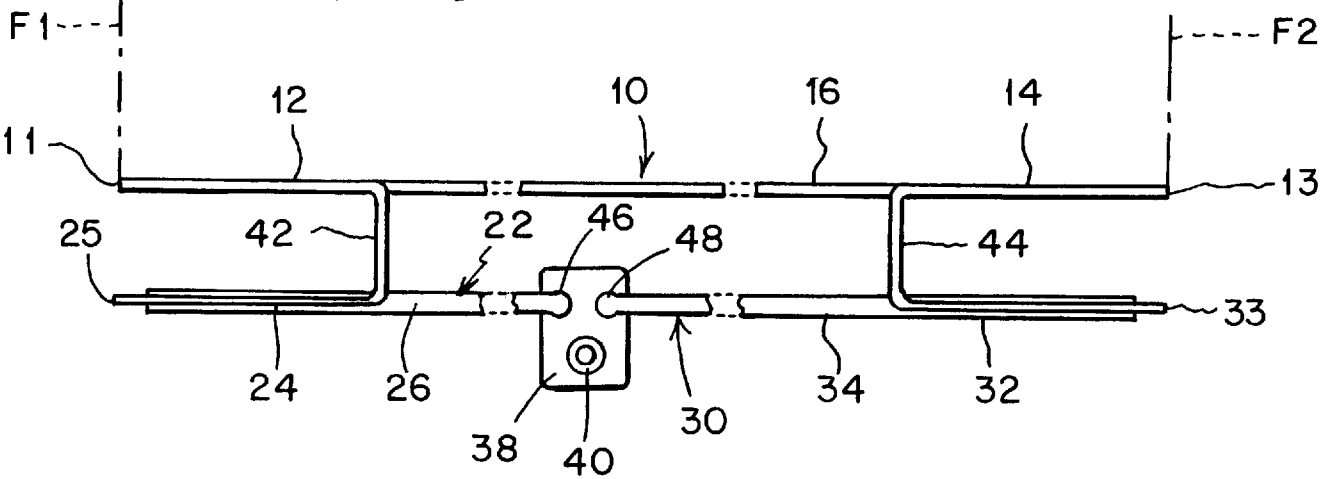
FIG. 3 is a schematic top plan view, on a similarly reduced scale, of the folded dipole antenna of FIGS. 1 and 2.

All of the conductors of the antenna device are rods or tubes made of copper or aluminum. Conductor 10 preferably has a diameter of approximately 0.050 inch, while conductor 22, and more particularly major portion 26 thereof, has a diameter of 0.125 inch. Connecting conductors 42 and 44 are approximately 0.050 inch in diameter. It is to be noted that the conductor lengths set forth herein include arcuate ends of the various linear segments (see FIG. 2) and are perhaps more accurately characterized as distances between ends of the respective linear conductors. For example, the length of 0.75 inch of connector pieces 18, 20, 28 and 36 is perhaps more accurately characterized as the distance between end segments 12 and 14 and central segment 16 or, concomitantly, as the distance between end portions 24 and 32 and the respective major portions 26 and 34 of conductors 22 and 30.

It is to be noted that terminals 46 and 48 of major conductor portions 26, instead of being connected to balun transformer 38, may be connected to respective wires of a balanced two-wire pair (not shown). In that case, a balun transformer (not shown) may be connected to the two wires at ends thereof opposite the dipole antenna.

A folded back dipole antenna as disclosed herein provides wide-angle coverage for television broadcast channels 2–13 and is an efficient receiver of wireless television signals at all channels (2–69).

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A television antenna device comprising:

A first linear conductor having a central segment and a pair of opposite end segments folded back to overlap said central segment, said end segments extending substantially parallel to said central segment and spaced therefrom;

a second linear conductor approximately half as long as said first linear conductor, said second linear conductor having a first major portion and a first end portion folded back at a first fold to overlap said first major portion, said first end portion extending substantially parallel to said first major portion in spaced relation thereto, said first end portion being connected at an end opposite said first fold to one of said end segments defining a first end section; and a third linear conductor approximately half as long as said first linear conductor, said third linear conductor having a second major portion and a second end portion folded back at a second fold to overlap said second major portion, said second end portion extending substantially parallel to said second major portion in spaced relation thereto, said second end portion being connected at an end opposite said second fold to another of said end segments defining a second end section, said first, second and third linear conductors having a combined electrical length of approximately one wavelength at a first frequency, $f_1$, said first and second end sections each having an electrical length of approximately ¼ wavelength at a second frequency, $f_2$, said second frequency being substantially equal to $4 \cdot f_1$, whereby the antenna device efficiently receives wireless television signals at essentially all channels without adjustment circuits.

2. The device defined in claim 1 wherein said central segment is spaced a pre-established distance from said first major portion and said second major portion.

3. The device defined in claim 2 wherein said one of said end segments is spaced a predetermined distance from said central segment, said first end portion is spaced by essentially said predetermined distance from said first major portion, said another of said end segments is spaced by essentially said predetermined distance from said central segment, and said second end portion is spaced by essentially said predetermined distance from said second major portion.

4. The device defined in claim 3 wherein said predetermined distance is approximately 0.75 inch and said pre-established distance is approximately 1.5 inches.

5. The device defined in claim 4 wherein said central segment has a length of approximately 73 inches and said first end portion and said second end portion each have a length of approximately 5.5 inches.

6. The device defined in claim 2 wherein said pre-established distance is approximately 1.5 inches.

* * * * *